US005924624A

United States Patent [19]

Martin

[11] Patent Number: 5,924,624

[45] Date of Patent: Jul. 20, 1999

[54] MAGNETIC POCKET FRAME

[75] Inventor: John J. Martin, Louisville, Ky.

[73] Assignee: Crane Productions, Inc., Louisville, Ky.

[21] Appl. No.: 08/982,621

[22] Filed: Dec. 2, 1997

Related U.S. Application Data

[63] Continuation-in-part of application No. 08/905,037, Aug. 1, 1997, which is a continuation of application No. 08/484,990, Jun. 7, 1995, abandoned.

[51] Int. Cl.[6] ..... B65D 27/04

[52] U.S. Cl. ..... 229/71; 40/711; 40/722; 40/774; 40/776; 229/92.8

[58] Field of Search ..... 40/711, 722, 725, 40/774, 775, 776; 229/71, 928

[56] References Cited

U.S. PATENT DOCUMENTS

| | | | |
|---|---|---|---|
| 769,536 | 9/1904 | Dixon . | |
| 2,576,667 | 11/1951 | Bly | 229/92.8 |
| 3,007,568 | 11/1961 | Kurland . | |
| 3,184,150 | 5/1965 | Hubbard . | |
| 3,237,327 | 3/1966 | Griggs . | |
| 4,044,942 | 8/1977 | Sherwood . | |
| 4,778,101 | 10/1988 | Paquin | 229/71 |
| 5,156,274 | 10/1992 | Williams, Jr. et al. . | |
| 5,261,174 | 11/1993 | Blegen | 40/711 |

*Primary Examiner*—Stephen P. Garbe
*Attorney, Agent, or Firm*—Middleton & Reutlinger; James C. Eaves, Jr.

[57] ABSTRACT

A magnetic pocket frame providing a planar blank including first and second planar surfaces, and first and second fold lines, the first and second fold lines dividing the planar blank into a back wall portion, a protective flap being disposed adjacent the back wall portion along the first fold line, and a pocket-forming flap being disposed adjacent the back wall portion along the second fold line; a flexible magnetic sheet adhesively secured to the second planar surface of the pocket-forming flap, the flexible magnetic sheet being capable of magnetically holding the magnetic pocket card to a magnetic surface in any angular orientation thereto; an opening provided through the back wall portion; a pair of continuous perforation lines extending transversely across the protective flap from a first side edge thereof to a second side edge thereof; the pocket-forming flap being foldable about the second fold line over the back wall potion and being secured thereto at at least one preselected location thereon, thereby forming a pocket between the back wall portion and the pocket-forming flap; the protective flap being foldable about the first fold line over the pocket-forming flap and being secured thereto at at least one preselected location thereon, the at least one preselected location being disposed between the flexible magnetic sheet and the second fold line, the flexible magnetic sheet being disposed completely between the pair of perforation lines.

13 Claims, 10 Drawing Sheets

MAGNETIC POCKET FRAME

CROSS-REFERENCE TO RELATED APPLICATIONS

This application is a continuation-in-part ("CIP") of, and claims priority from, my U.S. Utility patent application Ser. No. 08/905,037 entitled "Magnetic Pocket Card" filed on Aug. 1, 1997, said '037 Application being incorporated herein by reference, being a continuation of, and claiming priority from, my U.S. Utility patent application Ser. No. 08/484,990 entitled "Magnetic Pocket Card" filed on Jun. 7, 1995, now abandoned, said '990 Application being incorporated herein by reference.

BACKGROUND OF THE INVENTION

1. Technical Field of the Invention

The present invention relates to pocket frames for receiving inserts therein. More particularly, the present invention relates to a pocket frame for holding an insert therein, wherein the pocket frame is provided with a magnet for removably attaching the pocket frame to a magnetic surface, and wherein the pocket frame is provided with a window for displaying the insert therethrough.

2. Description of the Related Art

It is oftentimes desirable to provide a foldable pocket card for receiving inserts therein, such as, for example, to mail letters, cards, certificates, coupons, photographs, or the like. For example, U.S. Pat. No. 4,044,942 to Sherwood teaches a multiple mailing folder adaptable to mail such inserts, and U.S. Pat. No. 5,156,274 to Williams, Jr., et al., teaches an emergency breakdown assistance kit including a polyethylene envelope having a plurality of signs provided therein for viewing therethrough.

BRIEF SUMMARY OF THE INVENTION

The present invention is for a magnetic pocket frame being defined by a foldable planar blank and having a pocket for receiving at least one insert therein, such as, for example, a letter, card, certificate, coupon, photograph or the like. The planar blank includes a plurality of flaps being foldable to define an insert-receiving pocket and a protective flap foldable thereover suitable for mailing the at least one insert therein. The protective flap includes a tear-away portion defined by a pair of perforation lines, wherein the tear-away portion can be removed to expose a magnet attached to the pocket frame thereunder and to provide access to the pocket for removal of the at least one insert therefrom.

Once the tear-away portion of the protective flap has been removed, the magnetic pocket frame is removably attachable to a magnetic surface, such as, for example, a refrigerator, filing cabinet, office desk, or the like. A back wall of the pocket frame may be provided with a window therethrough for viewing one of the at least one insert disposed therein after mailing. The pocket frame is reusable to provide a magnetically-attachable frame for viewing any insert of the type hereinabove described, whether or not such insert was originally mailed in the pocket frame.

It is an object of the present invention to provide a magnetic pocket frame being suitable for holding and mailing at least one insert therein.

It is another object of the present invention to provide a magnetic pocket frame being suitable for holding at least one insert therein and having a window provided in one wall thereof to permit viewing of the at least one insert therethrough.

It is yet another object of the present invention to provide a magnetic pocket frame being suitable for holding at least one insert therein and being removably attachable to a magnetic surface.

It is still another object of the present invention to provide a magnetic pocket frame being suitable for holding at least one insert therein, having a window in one wall thereof to permit viewing of the at least one insert therethrough and being reusable to provide a frame for viewing an insert of the type receivable by the pocket frame.

A magnetic pocket frame according to a preferred embodiment of the present invention includes a planar blank having first and second planar surfaces, and first and second fold lines, the first and second fold lines dividing the planar blank into a back wall portion, a protective flap being disposed adjacent the back wall portion along the first fold line, and a pocket-forming flap being disposed adjacent the back wall portion along the second fold line; a flexible magnetic sheet adhesively secured to the second planar surface of the pocket-forming flap, the flexible magnetic sheet being capable of magnetically holding the magnetic pocket card to a magnetic surface in any angular orientation thereto; an opening provided through the back wall portion; a pair of continuous perforation lines extending transversely across the protective flap from a first side edge thereof to a second side edge thereof; the pocket-forming flap being foldable about the second fold line over the back wall potion and being secured thereto at at least one preselected location thereon, thereby forming a pocket between the back wall portion and the pocket-forming flap; the protective flap being foldable about the first fold line over the pocket-forming flap and being secured thereto at at least one preselected location thereon, the at least one preselected location being disposed between the flexible magnetic sheet and the second fold line, the flexible magnetic sheet being disposed completely between the pair of perforation lines.

BRIEF DESCRIPTION OF THE SEVERAL VIEWS OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
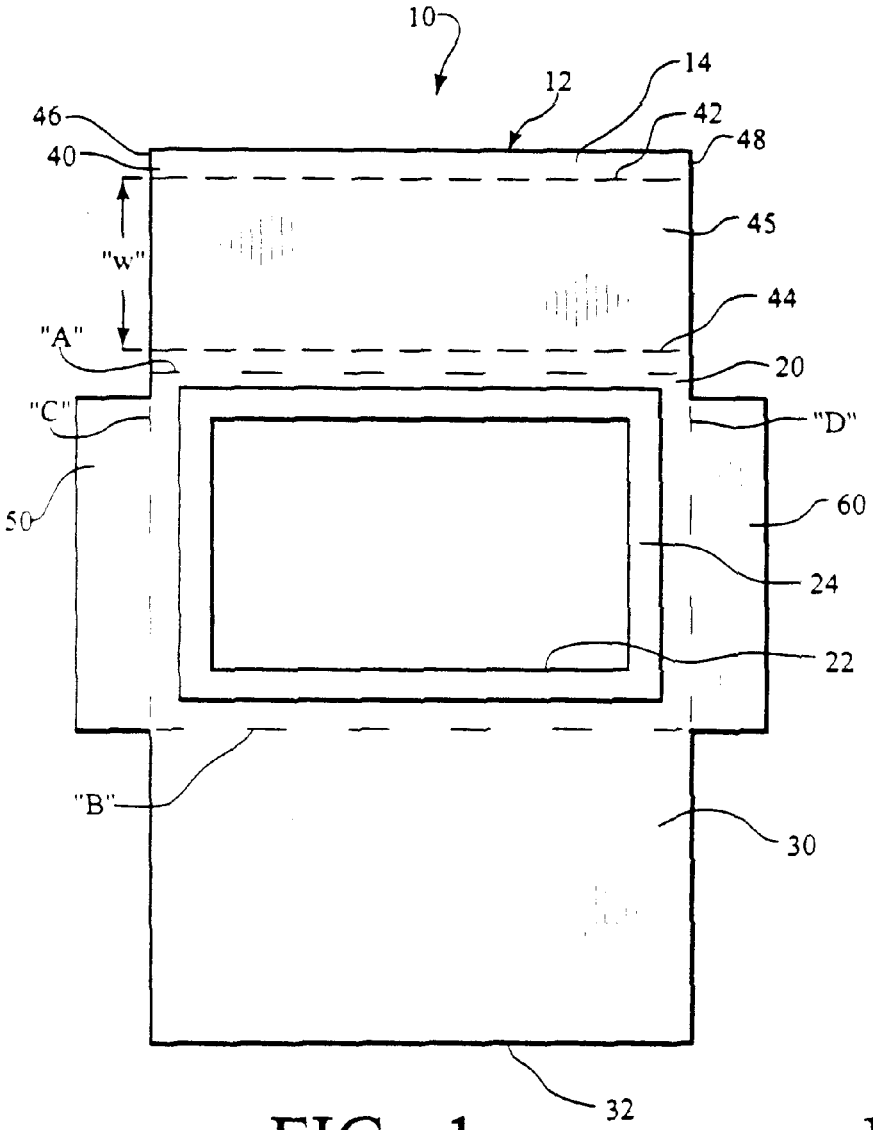
FIG. 1 is a front view of a planar blank being foldable to define a magnetic pocket frame according to a preferred embodiment of the present invention.
Figure 2:
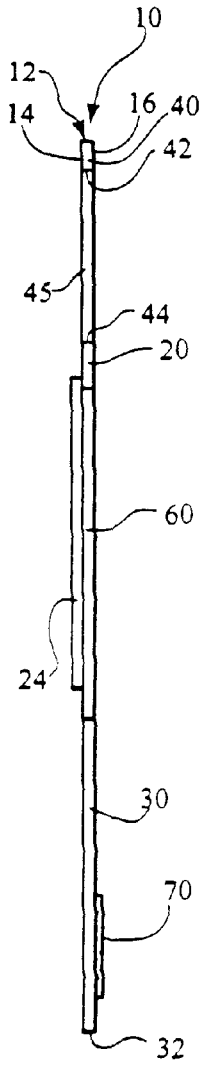
FIG. 2 is a side view of the planar blank of FIG. 1.
Figure 9:
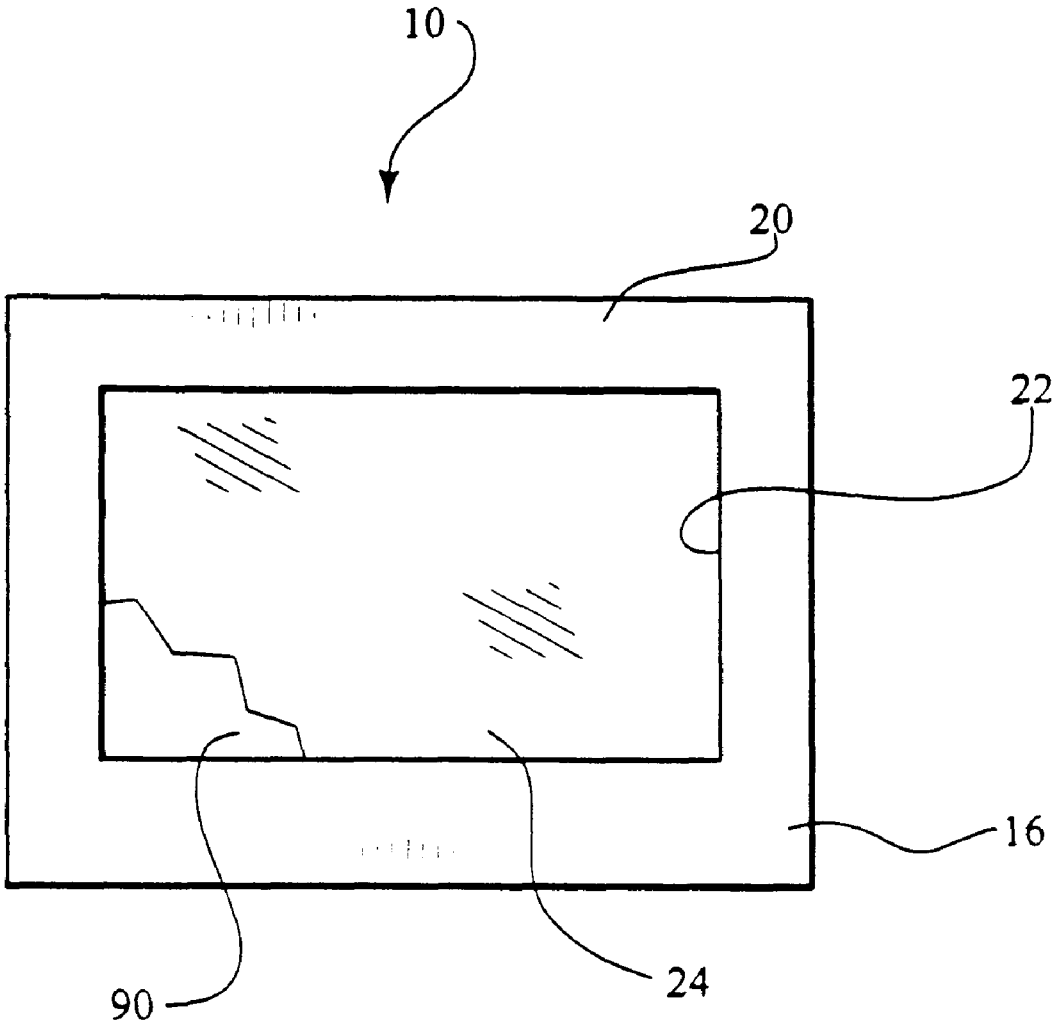
FIG. 9 is a rear view of the magnetic pocket frame of FIG. 7, wherein a portion of a transparent film has been removed for illustration.
Figure 10:
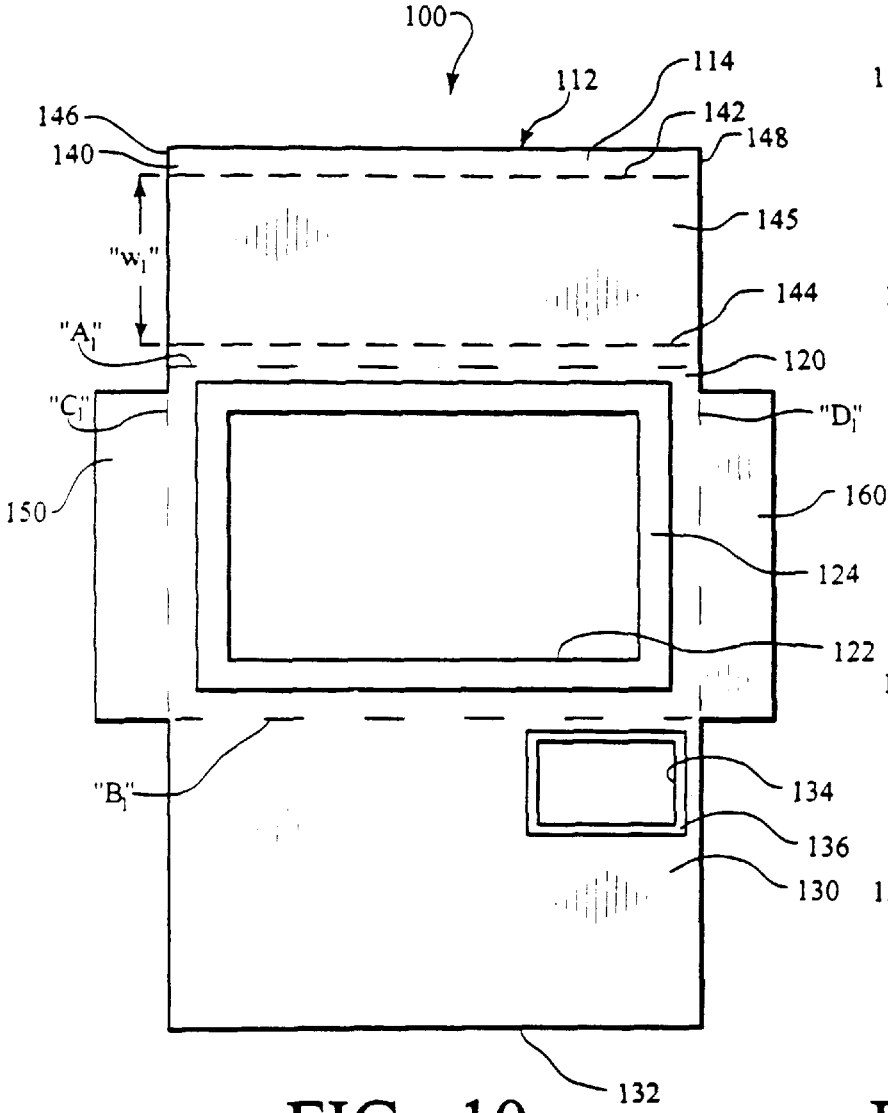
FIG. 10 is a front view of a planar blank being foldable to define a magnetic pocket frame according to an alternative embodiment of the present invention.
Figure 11:
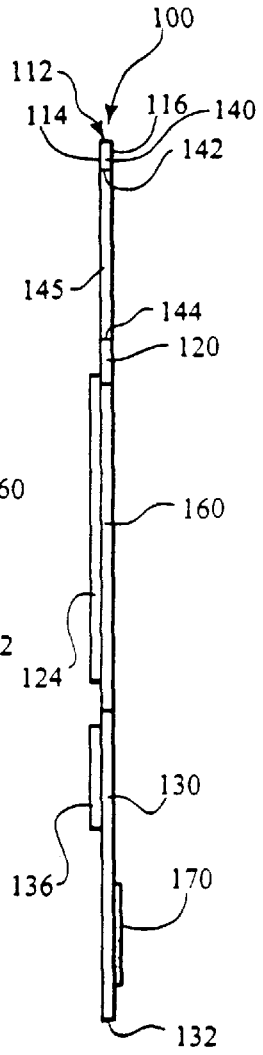
FIG. 11 is a side view of the planar blank of FIG. 10.
Figure 12:
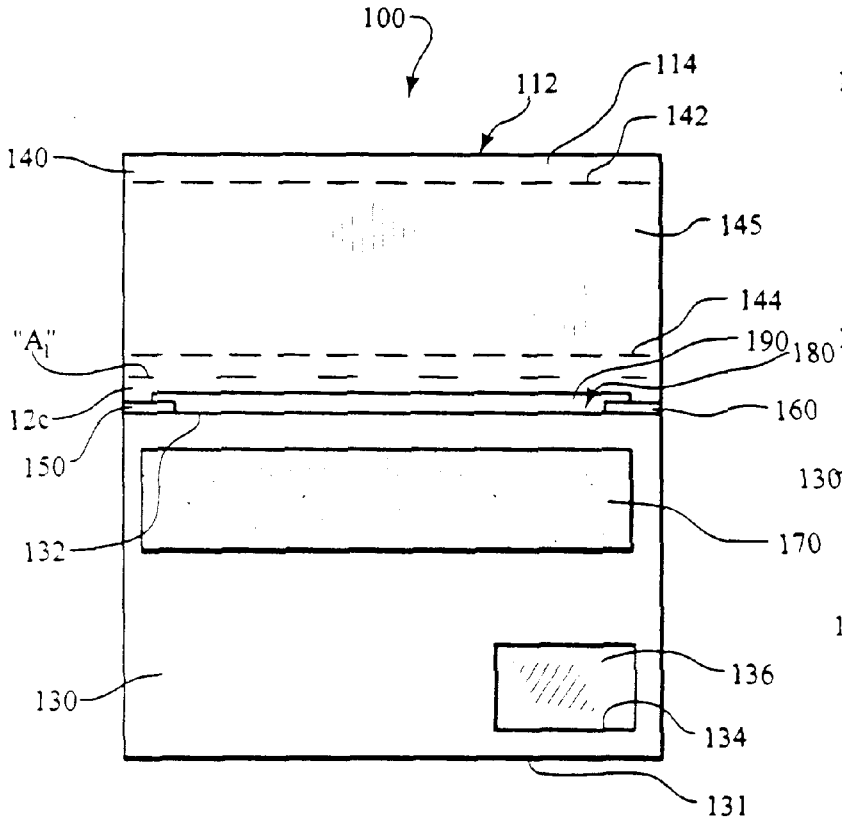
FIG. 12 is a front view of a magnetic pocket frame being defined by the planar blank of FIG. 10.
Figure 13:
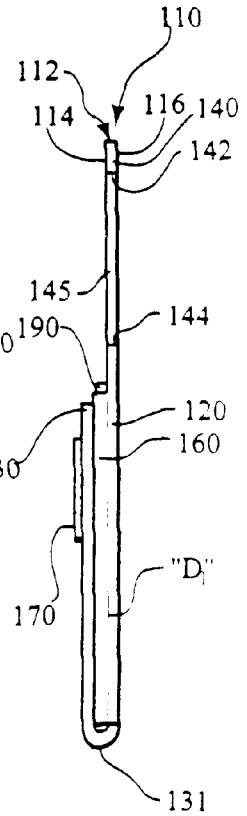
FIG. 13 is a side view of the magnetic pocket frame of FIG. 12.
Figure 14:
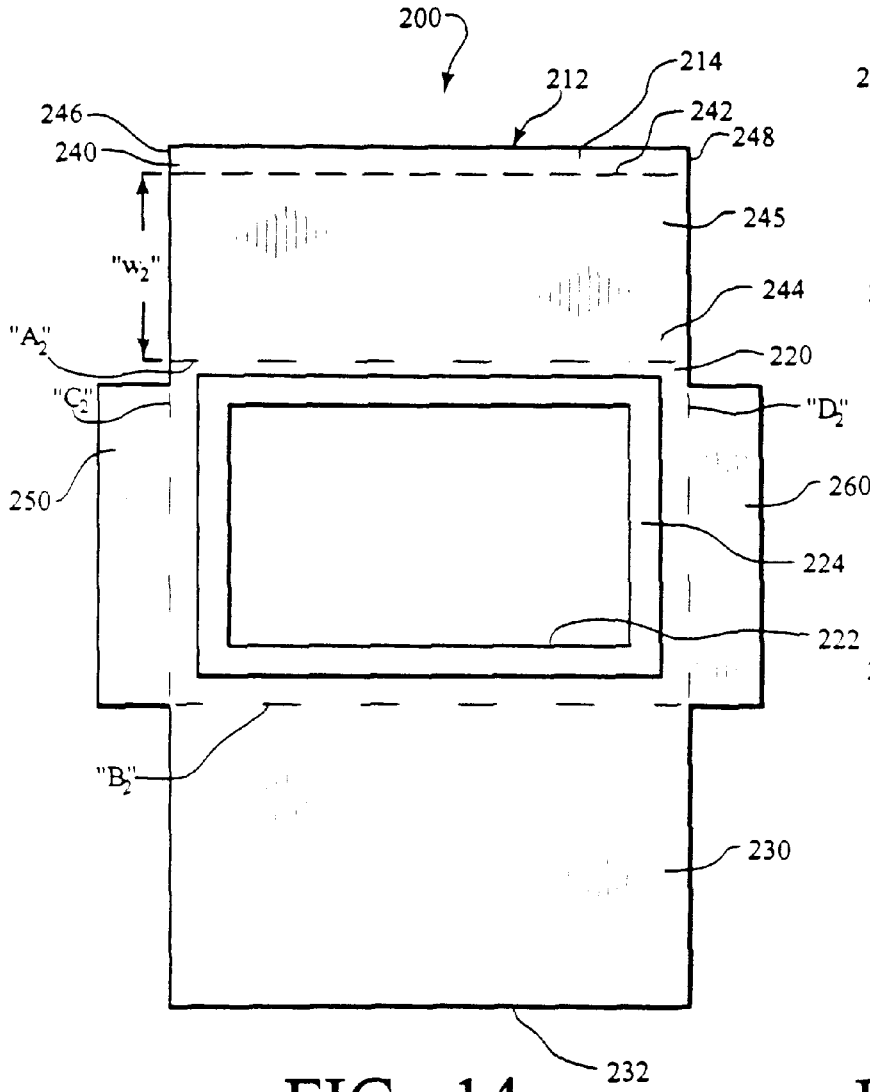
FIG. 14 is a front view of a planar blank being foldable to define a magnetic pocket frame according to an alternative embodiment of the present invention.
Figure 15:
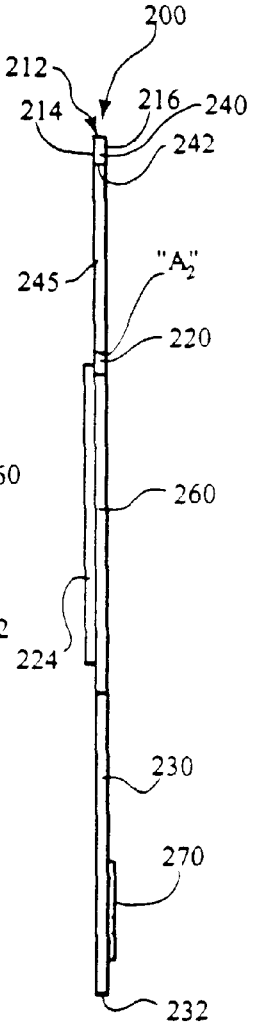
FIG. 15 is a side view of the planar blank of FIG. 14.
Figure 16:
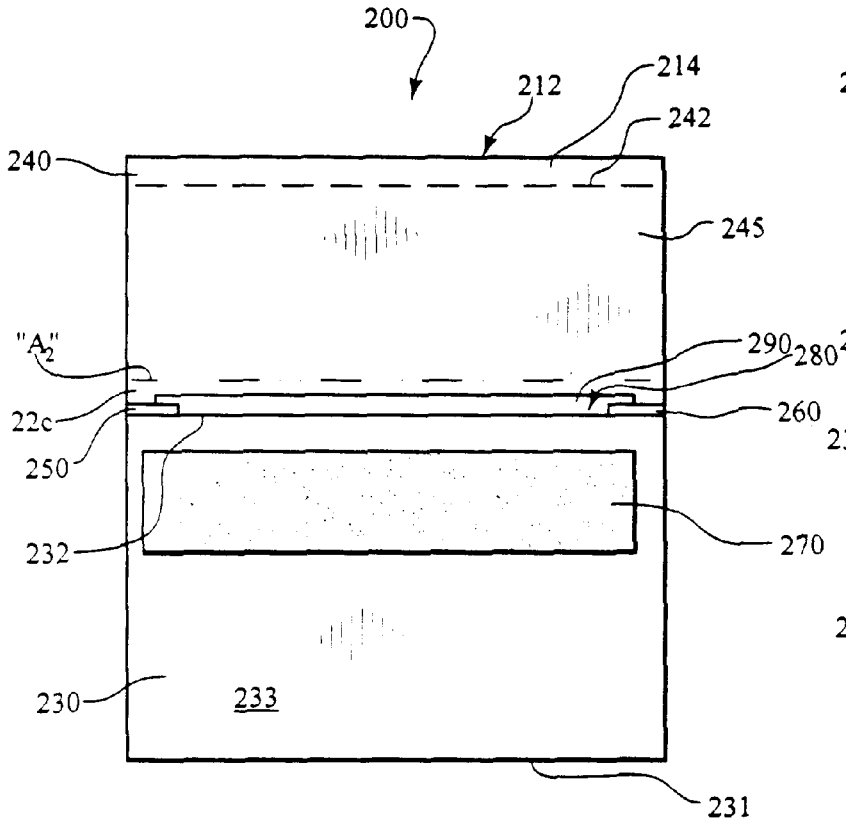
FIG. 16 is a front view of a magnetic pocket frame being defined by the planar blank of FIG. 14.
Figure 17:
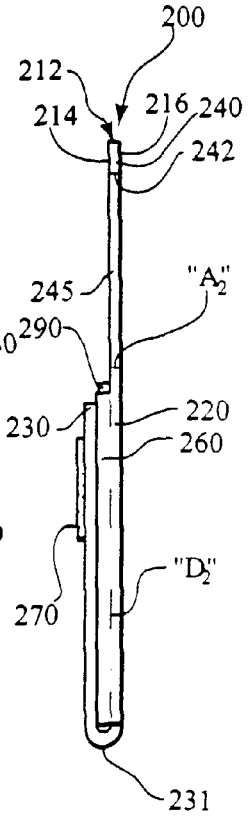
FIG. 17 is a side view of the magnetic pocket frame of FIG. 16.
Figure 18:
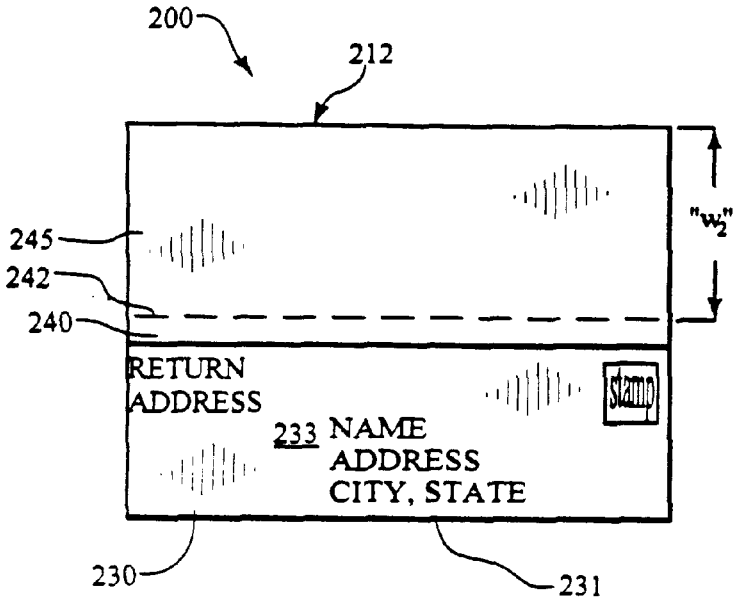
FIG. 18 is a front view of the magnetic pocket frame of FIG. 16 being fully folded and prior to removal of a tear-out portion of a protective flap provided thereby.
Figure 19:
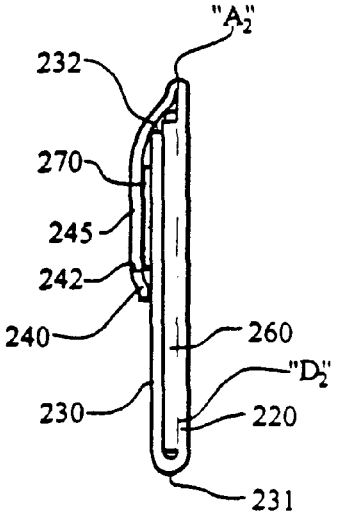
FIG. 19 is a side view of the magnetic pocket frame of FIG. 18.
Figure 20:
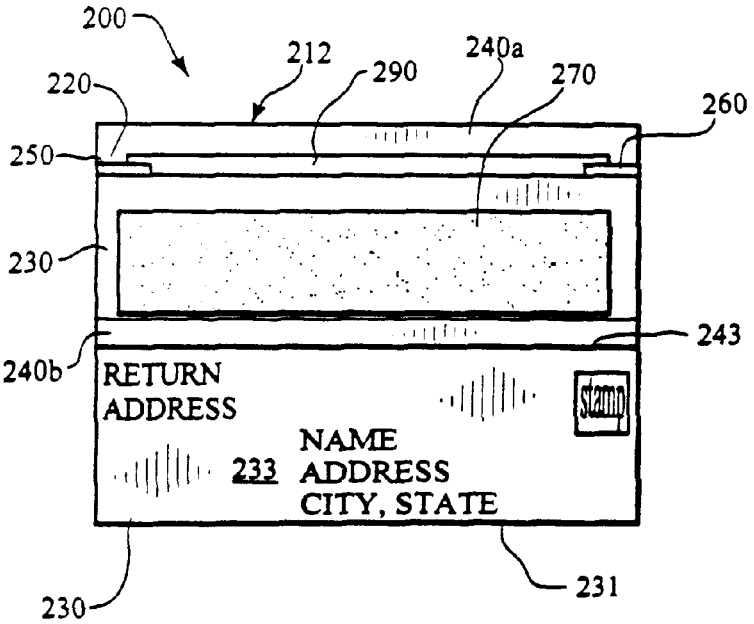
FIG. 20 is a front view of the magnetic pocket frame of FIG. 16 being fully folded and after removal of a tear-out portion of a protective flap provided thereby.
Figure 21:
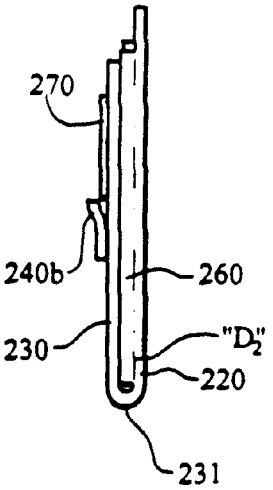
FIG. 21 is a side view of the magnetic pocket frame of FIG. 20.

With reference to FIGS. 1 and 2, a magnetic pocket frame 10 according to a preferred embodiment of the present invention is defined by a planar blank 12 having a first planar surface 14 and a second planar surface 16. The planar blank 12 is divided by fold lines "A", "B" into a back wall 20, a pocket-forming flap 30 being upwardly foldable about fold line "B" over the first planar surface 14 of the back wall, and a protective flap 40 being downwardly foldable about fold line "A" over the first planar surface 14 of the back wall 20. An opening 22 is provided through the back wall 20, substantially centered with respect thereto, and may be covered on one side thereof with a thin, flexible transparent film 24, such as, for example, polyethylene. The opening 22 defines a window through the back wall 20 to permit viewing therein from the rear of the pocket frame 10 (FIG. 9). The film 24 is adhesively secured to the first planar surface 14 of the back wall 20 between an outer periphery of the opening 22 and an outer periphery of the back wall 20 being defined by respective fold lines "A", "B", "C" and "D". The opening 22 may be of any size sufficient to permit viewing therethrough of a variety of inserts 90 (FIG. 3) having different sizes, such as, for example, 3"×5" or 4"×6" postcards or photographs, provided sufficient width is provided around the opening 22 between the opening outer periphery and the back wall outer periphery to which the transparent film 24 may be adhesively secured.

The protective flap 40 includes a pair of perforations 42, 44, preferably parallel and extending transversely therethrough from a first side edge 46 thereof to a second side edge 48 thereof. The perforations 42, 44 define a tear-away portion 45 therebetween disposed towards the fold line "A". The perforations 42, 44 may be of any relative angular orientation, such as, for example, parallel, convergent or divergent.

Side flaps 50, 60 form an integral construction with the planar blank 12 and project transversely outwardly from the back wall 20, the side flaps 50, 60 being coplanar with the planar blank 12 and being foldable thereover about fold lines "C", "D", respectively. Fold lines "C", "D" are substantially transverse to fold lines "A", "B" and are substantially collinear with first and second side edges 46, 48, respectively, of protective flap 40. Alternatively, instead of flaps 50, 60, an adhesive can be used along the sides of back wall 20 and sides of flap 30 to attach back wall 20 and flap 30 directly to each other.

A thin, flexible magnetic sheet material 70 is adhesively secured to the second planar surface 16 of the pocket-forming flap 30 towards a outermost end 32 thereof. The thin sheet of flexible magnetic material 70 is known and is preferably a vinyl material including magnetic materials dispersed therethrough. Such a sheet of flexible magnetic material can be commercially purchased under the trademark "UltraMag" from Flex-Mag Industrial, Inc., a division of Dynacast Co., Marietta, Ohio.

Figure 3:
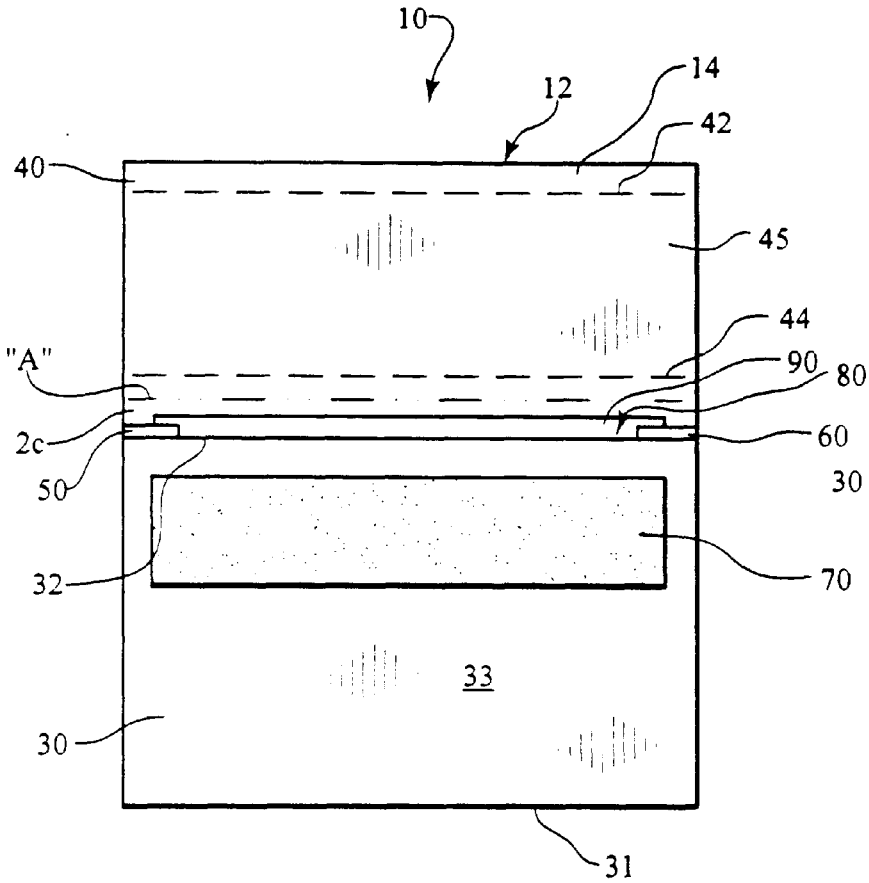
FIG. 3 is a front view of a magnetic pocket frame being defined by the planar blank of FIG. 1.
Figure 4:
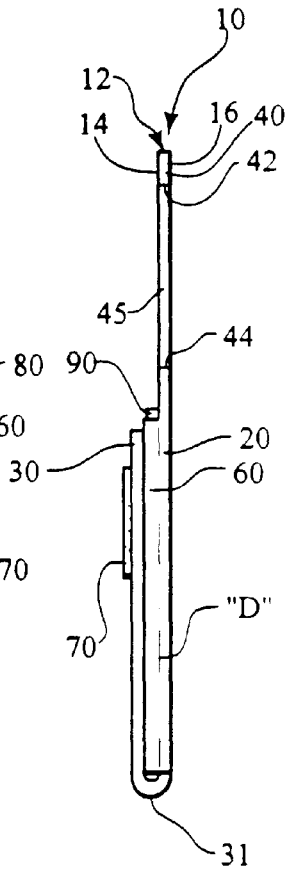
FIG. 4 is a side view of the magnetic pocket frame of FIG. 3.

With reference to FIGS. 3 and 4, the planar blank 12 is foldable into the pocket frame 10 about fold lines "B", "C" and "D" to form a pocket 80 defined by the back wall 20, the first and second side flaps 50, 60, respectively, and the pocket-forming flap 30. The pocket 80 is sized to receive at least one insert 90 therein, such as, for example, a letter, card, certificate, coupon, photograph or the like. More particularly, the pocket 80 is formed by preferably folding the first and second flaps 50, 60 inwardly about folding lines "C", "D", respectively, over the first planar surface 14 of the back wall 20. The pocket-forming flap 30 is folded upwardly about fold line "B" over the first planar surface 14 of the back wall 20 and over each respective second planar surface 16 of the inwardly-folded side flaps 50, 60, to which the first planar surface 14 of the pocket-forming flap 30 is adhesively secured thereto.

Figure 5:
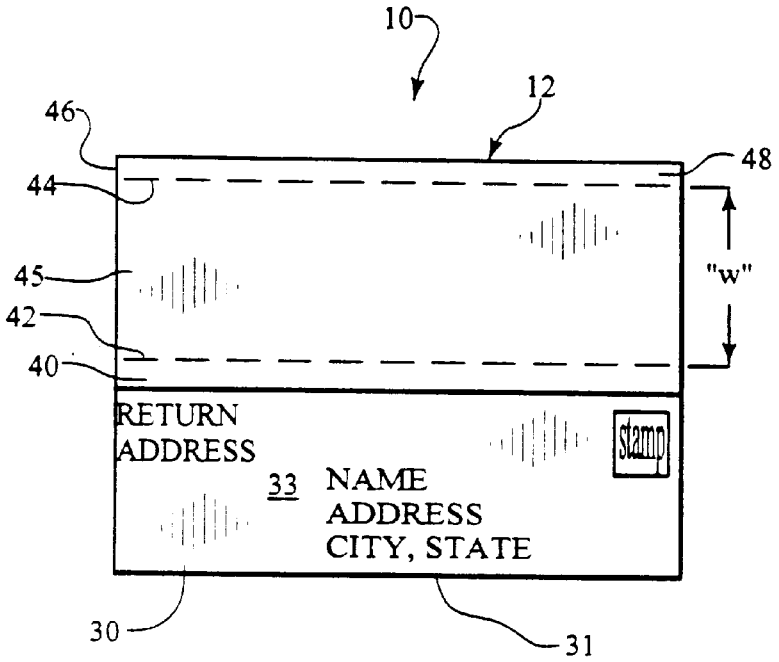
FIG. 5 is a front view of the magnetic pocket frame of FIG. 3 being fully folded and prior to removal of a tear-out portion of a protective flap provided thereby.
Figure 6:
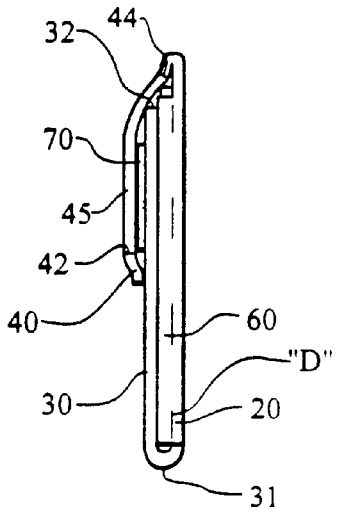
FIG. 6 is a side view of the magnetic pocket frame of FIG. 5.

With reference to FIGS. 5 and 6, the pocket frame 10 is folded into an orientation suitable for mailing as a first-class mail item by the U.S. Postal Service. More particularly, the protective flap 40 is foldable downwardly over the first planar surface 14 of the back wall 20 over the flexible magnetic sheet material 70 and over the second planar surface 16 of the upwardly-folded pocket-forming flap 30.

The first planer surface 14 of the protective flap 40 is adhesively secured to the first planar surface 14 of the back wall 20, by a first line of adhesive, preferably about ½" wide, extending transversely thereacross from the first side edge 46 of the protective flap 40 to the second side edge 48 of the protective flap 40. The first line of adhesive is disposed near the fold line "A", substantially parallel thereto, and between the fold line "A" and an upper edge of the opening 80 being defined by the lower end 32 of the pocket-forming flap 30 having been upwardly folded. Alternatively, the first line of adhesive need not extend continuously between first and second side edges 46, 48 of the protective flap 40, but may extend only over a portion thereof.

The first planar surface 14 of the protective flap 40 is adhesively secured to the second planar surface 16 of the pocket-forming flap 30, by a second line of adhesive, preferably about ½" wide, extending transversely thereacross from the first side edge 46 of the protective flap 40 to the second side edge 48 of the protective flap 40. The second line of adhesive is disposed between perforation line 42, substantially parallel thereto, and an outermost end 43 of the protective flap 40. Alternatively, the second line of adhesive need not extend continuously between first and second side edges 46, 48 of the protective flap 40, but may extend only over a portion thereof.

The tear-away portion 45 is sufficiently wide, as generally indicated by reference numeral "w", to substantially cover the flexible sheet of magnetic material 70 thereunder when the protective flap 40 is folded downwardly thereover and adhesively secured to the pocket frame 10 as hereinabove described. The protective flap 40 is sized to completely cover the flexible sheet of magnetic material 70 and a portion of the second planar surface 16 of the pocket-forming flap 30 thereunder, and defines a lower portion 33 of the second planar surface 16 of the pocket-forming flap 30 between the outermost end 43 of the protective flap 40 and a lower end 31 of the pocket-forming flap 30 being defined by fold line "B". The lower portion 33 can be printed with indicia indicating the location of a postage stamp, location of addressee information, and location of return address information. Alternatively, a label providing such indicia may be adhesively secured to the lower portion 33 in lieu of printing such indicia directly thereon.

To expose the flexible sheet of magnetic material 70, such as, for example, when an individual wishes to magnetically secure the pocket frame 10 to a magnetic surface, the individual grasps one edge of the tear-away portion 45 being defined by a respective side edge 46, 48 of the protective flap 40, and pulls upwardly therefrom, thereby tearing the protective flap 40 along the perforation lines 42, 44 and removing the tear-away portion 45 therefrom.

Figure 7:
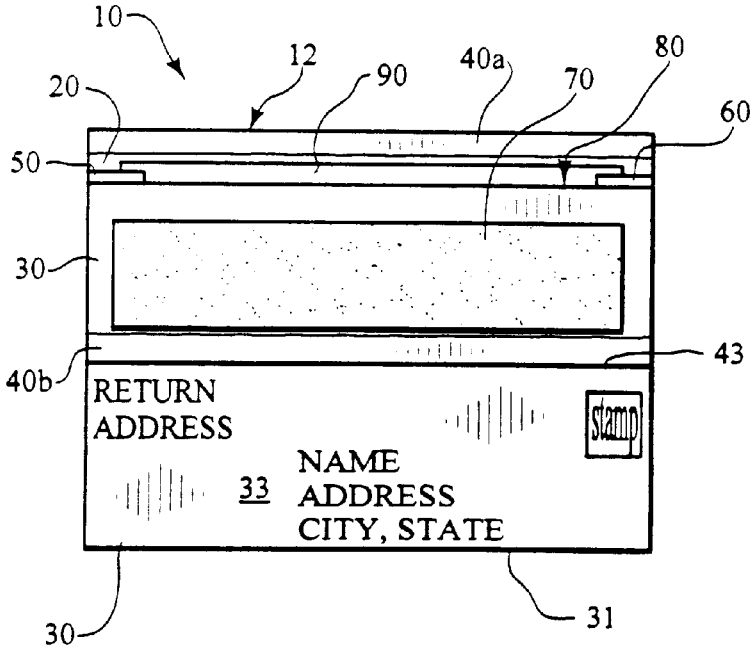
FIG. 7 is a front view of the magnetic pocket frame of FIG. 3 being fully folded and after removal of a tear-out portion of a protective flap provided thereby.
Figure 8:
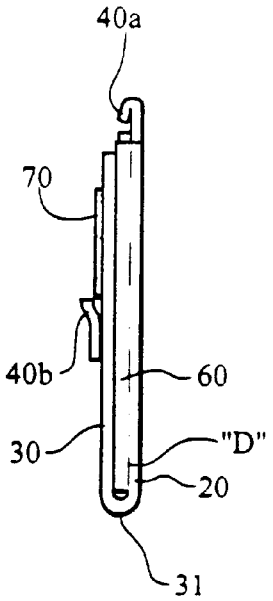
FIG. 8 is a side view of the magnetic pocket frame of FIG. 7.

With reference to FIGS. 7–9, the first and second adhesive strips secure the remainder of the protective flap 40*a,* 40*b* to the pocket frame 10, while providing access to the pocket 80 and to the at least one insert 90 being disposed therein. The insert 90 is viewable through the opening 22 provided in the back wall 20, the second planar surface 16 of which may be provided with shading or other effects to provide the appearance of a picture frame. Alternatively, advertisements or other indicia may be provided on the second planar surface 16 of the back wall 20 around the opening 22.

The pocket frame 10 is removably securable to a magnetic surface, such as, for example, a refrigerator, filing cabinet, office desk, or the like, and provides an attractive frame from which to display a card, certificate, photograph, or the like. The flexible sheet of magnetic material 70 is preferably sized and positioned on the second planar surface 16 of the pocket-forming flap 30 to provide sufficient magnetic bonding strength of the pocket frame 10 to a magnetic surface in either a horizontal (so-called "landscape") orientation, as generally depicted in the Figures, or a vertical (so-called "portrait") orientation. However, if desired, magnetic material 70 could completely cover flap 30, or any portion thereof, on surface 16.

With reference to FIGS. 10–13, a magnetic pocket frame 100 according to an alternative embodiment of the present invention is defined by a planar blank 112 having a first planar surface 114 and a second planar surface 116. The planar blank 112 is divided by fold lines "$A_1$", "$B_1$" into a back wall 120, a pocket-forming flap 130 being upwardly foldable about fold line "$B_1$" over the first planar surface 114 of the back wall, and a protective flap 140 being downwardly foldable about fold line "$A_1$" over the first planar surface 114 of the back wall 120. An opening 122 is provided through the back wall 120, substantially centered with respect thereto, and may be covered on one side thereof with a thin, flexible transparent film 124, such as, for example, polyethylene. The opening 122 defines a window through the back wall 120 to permit viewing therein from the rear of the pocket frame 110. The film 124 is adhesively secured to the first planar surface 114 of the back wall 120 between an outer periphery of the opening 122 and an outer periphery of the back wall 120 being defined by respective fold lines "$A_1$", "$B_1$", "$C_1$" and "$D_1$". The opening 122 may be of any size sufficient to permit viewing therethrough of a variety of inserts 190 (FIG. 12) having different sizes, such as, for example, 3"×5" or 4"×6" postcards or photographs, provided sufficient width is provided around the opening 122 between the opening outer periphery and the back wall outer periphery to which the transparent film 124 may be adhesively secured.

The protective flap 140 includes a pair of perforations 142, 144 extending transversely therethrough from a first side edge 146 thereof to a second side edge 148 thereof. The perforations 142, 144 define a tear-away portion 145 therebetween disposed towards the fold line "$A_1$".

Side flaps 150, 160 form an integral construction with the planar blank 112 and project transversely outwardly from the back wall 120, the side flaps 150, 160 being coplanar with the planar blank 112 and being foldable thereover about fold lines "$C_1$", "$D_1$", respectively. Fold lines "$C_1$", "$D_1$" are substantially transverse to fold lines "$A_1$", "$B_1$" and are substantially collinear with first and second side edges 146, 148, respectively, of the protective flap 140.

A thin, flexible magnetic sheet material 170 is adhesively secured to the second planar surface 116 of the pocket-forming flap 130 towards a outermost end 132 thereof. The thin sheet of flexible magnetic material 170 is known and is preferably a vinyl material including magnetic materials dispersed therethrough. Such a sheet of flexible magnetic material can be commercially purchased under the trademark "UltraMag" from Flex-Mag Industrial, Inc., a division of Dynacast Co., Marietta, Ohio.

The planar blank 112 is foldable into the pocket frame 100 about fold lines "$B_1$", "$C_1$" and "$D_1$" to form a pocket 180 defined by the back wall 120, the first and second side flaps 150, 160, respectively, and the pocket-forming flap 130. The pocket 180 is sized to receive at least one insert 190 therein, such as, for example, a letter, card, certificate, coupon, photograph or the like. More particularly, the pocket 180 is formed by folding the first and second flaps 150, 160 inwardly about folding lines "$C_1$", "$D_1$", respectively, and over the first planar surface 114 of the back wall 120. The pocket-forming flap 130 is folded upwardly about fold line "$B_1$" over the first planar surface 114 of the back wall 120 and over each respective second planar surface 116 of the inwardly-folded side flaps 150, 160, to which the first planar surface 114 of the pocket-forming flap 130 is adhesively secured thereto.

The pocket frame 100 is folded into an orientation suitable for mailing as a first-class package by the U.S. Postal Service. More particularly, the protective flap 140 is foldable downwardly over the first planar surface 114 of the back wall 120 over the flexible magnetic sheet material 170 and over the second planar surface 116 of the upwardly-folded pocket-forming flap 130. The pocket-forming flap 130 is provided with an opening 134 therethrough, preferably located towards a pocket end 131 of the pocket-forming flap 130, and may be covered on one side thereof by a thin, flexible transparent film 136, such as, for example, polyethylene. The opening 134 defines an address window through the pocket-forming flap 130 to permit viewing of an address card (not shown) containing mailing information provided in the pocket 180 between the at least one insert 190 and the pocket-forming flap 130. The film 136 is adhesively secured to the first planar surface 114 of the pocket-forming flap 140 around an outer periphery thereof. Opening 134 can be sized as desired to also permit viewing of return address information and postage information. Alternatively, some or all of this information can be printed directly on flap 130.

The first planer surface 114 of the protective flap 140 is adhesively secured to the first planar surface 114 of the back wall 120, by a first line of adhesive, preferably about ½" wide, extending transversely thereacross from the first side edge 146 of the protective flap 140 to the second side edge 148 of the protective flap 140. The first line of adhesive is disposed near the fold line "$A_1$", substantially parallel thereto, and between the fold line "$A_1$" and an upper edge of the opening 180 being defined by the lower end 132 of the pocket-forming flap 130 having been folded upwardly. Alternatively, the first line of adhesive need not extend continuously between first and second side edges 146, 148 of the protective flap 140, but may extend only over a portion thereof.

The first planar surface 114 of the protective flap 140 is adhesively secured to the second planar surface 116 of the pocket-forming flap 130, by a second line of adhesive, preferably about ½" wide, extending transversely thereacross from the first side edge 146 of the protective flap 140 to the second side edge 148 of the protective flap 140. The second line of adhesive is disposed between perforation line 142, substantially parallel thereto, and an outermost end 143 of the protective flap 140. Alternatively, the second line of adhesive need not extend continuously between first and second side edges 146, 148 of the protective flap 140, but may extend only over a portion thereof.

The tear-away portion 145 is sufficiently wide, as generally indicated by reference numeral "$w_1$", to substantially cover the flexible sheet of magnetic material 170 thereunder when the protective flap 140 is folded downwardly thereover and adhesively secured to the pocket frame 100 as hereinabove described. The protective flap 140 is sized to completely cover the flexible sheet of magnetic material 170 and a portion of the second planar surface 116 of the pocket-forming flap 130 thereunder.

Removal of the tear-out portion 145 to expose the flexible sheet of magnetic material 170 disposed thereunder, and to permit access to the pocket 180 and to the at least one insert 190 being disposed therein, is as described hereinabove with respect to the preferred embodiment of the present invention.

With reference to FIGS. 14–21, a magnetic pocket frame 200 according to another alternative embodiment of the present invention is defined by a planar blank 212 having a first planar surface 214 and a second planar surface 216. The planar blank 212 is divided by fold lines "$A_2$", "$B_2$" into a back wall 220, a pocket-forming flap 230 being upwardly foldable about fold line "$B_2$" over the first planar surface 214 of the back wall, and a protective flap 240 being downwardly foldable about fold line "$A_2$" over the first planar surface 214 of the back wall 220. In the present embodiment, fold line "$A_2$" is preferably a perforation line, or the like. An opening 222 is provided through the back wall 220, substantially centered with respect thereto, and may be covered on one side thereof with a thin, flexible transparent film 224, such as, for example, polyethylene. The opening 222 defines a window through the back wall 220 to permit viewing therein from the rear of the pocket frame 210. The film 224 is adhesively secured to the first planar surface 214 of the back wall 220 between an outer periphery of the opening 222 and an outer periphery of the back wall 220 being defined by respective fold lines "$A_2$", "$B_2$", "$C_2$" and "$D_2$". The opening 222 may be of any size sufficient to permit viewing therethrough of a variety of inserts 290 (FIG. 16) having different sizes, such as, for example, 3"×5" or 4"×6" postcards or photographs, provided sufficient width is provided around the opening 222 between the opening outer periphery and the back wall outer periphery to which the transparent film 224 may be adhesively secured.

The protective flap 240 includes a perforation line 242 extending transversely therethrough from a first side edge 246 thereof to a second side edge 248 thereof. The perforation line 242 cooperates with fold line "$A_2$" to define a tear-out portion 245 therebetween disposed towards fold line "$A_2$".

Side flaps 250, 260 form an integral construction with the planar blank 212 and project transversely outwardly from the back wall 220, the side flaps 250, 260 being coplanar with the planar blank 212 and being foldable thereover about fold lines "$C_2$", "$D_2$", respectively. Fold lines "$C_2$", "$D_2$" are substantially transverse to fold lines "$A_2$", "$B_2$" and are substantially collinear with first and second side edges 246, 248, respectively, of the protective flap 240.

A thin, flexible magnetic sheet material 270 is adhesively secured to the second planar surface 216 of the pocket-forming flap 230 towards an outermost end 232 thereof. The thin sheet of flexible magnetic material 270 is known and is preferably a vinyl material including magnetic materials dispersed therethrough. Such a sheet of flexible magnetic material can be commercially purchased under the trademark "UltraMag" from Flex-Mag Industrial, Inc., a division of Dynacast Co., Marietta, Ohio.

The planar blank 212 is foldable into the pocket frame 200 about fold lines "$B_2$", "$C_2$" and "$D_2$" to form a pocket 280 defined by the back wall 220, the first and second side flaps 250, 260, respectively, and the pocket-forming flap 230. The pocket 280 is sized to receive at least one insert 290 therein, such as, for example, a letter, card, certificate, coupon, photograph or the like. More particularly, the pocket 280 is formed by folding the first and second flaps 250, 260 inwardly about folding lines "$C_2$", "$D_2$", respectively, and over the first planar surface 214 of the back wall 220. The pocket-forming flap 230 is folded upwardly about fold line "$B_2$", over the first planar surface 214 of the back wall 220, and over each respective second planar surface 216 of the inwardly-folded side flaps 250, 260, to which the first planar surface 214 of the pocket-forming flap 230 is adhesively secured thereto.

The pocket frame 200 is folded into an orientation suitable for mailing as a first-class package by the U.S. Postal Service. More particularly, the protective flap 240 is foldable downwardly over the first planar surface 214 of the back wall 220, over the flexible magnetic sheet material 270, and over the second planar surface 216 of the upwardly-folded pocket-forming flap 230.

Figure 22:
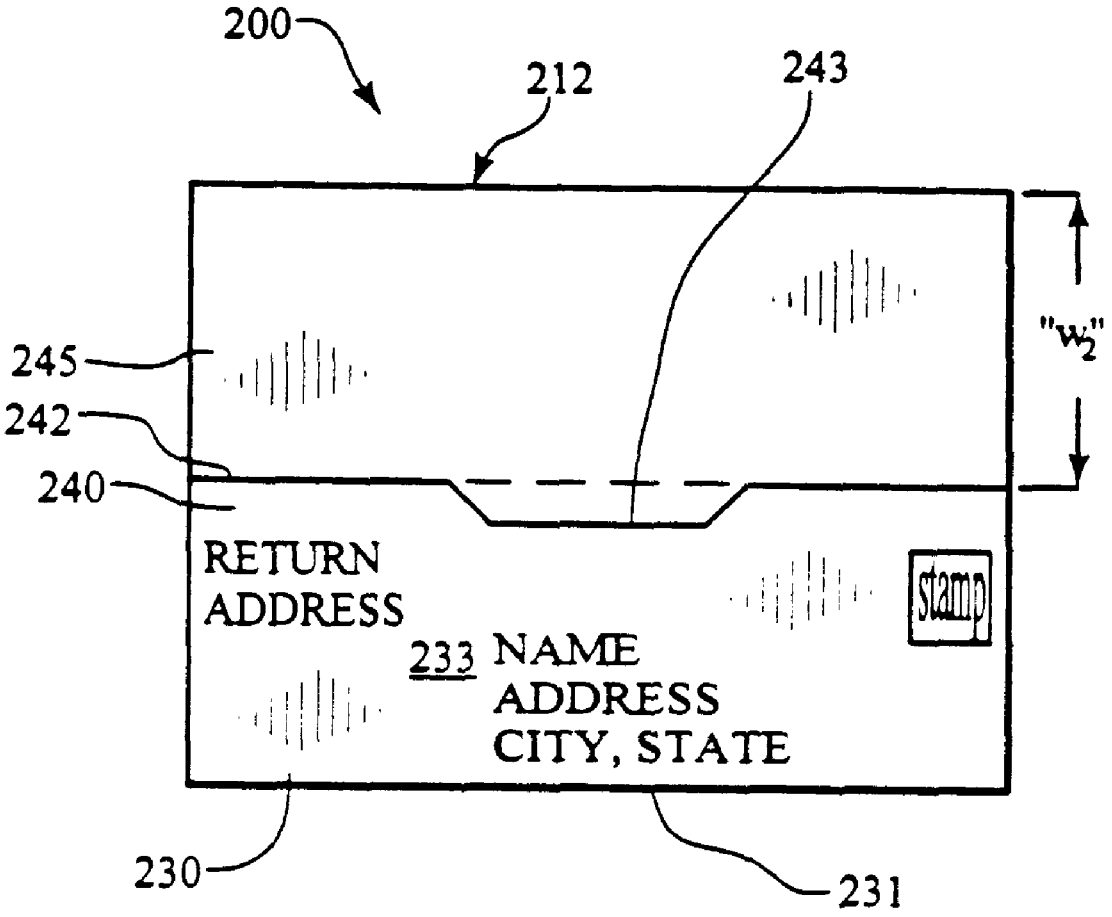
FIG. 22 is a front view of a magnetic pocket frame according to another alternative embodiment of the present invention.

The first planar surface 214 of the protective flap 240 is adhesively secured to the second planar surface 216 of the pocket-forming flap 230, by a line of adhesive, preferably ½" wide, extending transversely thereacross from the first side edge 246 of the protective flap 240 to the second side edge 248 of the protective flap 240. The line of adhesive is disposed between perforation line 242, substantially parallel thereto, and an outermost end 243 of the protective flap 240. Alternatively, the line of adhesive need not extend continuously between first and second side edges 246, 248 of the protective flap 240, but may extend only over a portion thereof. Even further, outermost end 243 does not need to extend linearly from side to side but could be a small downward extending center tab to which adhesive is attached (as shown in FIG. 22).

The tear-away portion 245 is sufficiently wide, as generally indicated by reference numeral "$w_2$", to substantially cover the flexible sheet of magnetic material 270 thereunder when the protective flap 240 is folded downwardly thereover and adhesively secured to the pocket frame 200 as hereinabove described. The protective flap 240 is sized to completely cover the flexible sheet of magnetic material 270 and a portion of the second planar surface 216 of the pocket-forming flap 230 thereunder, and defines a lower portion 233 of the second planar surface 216 of the pocket-forming flap 230 between the outermost end 243 of the protective flap 240 and a pocket end 231 of the pocket-forming flap 230 being defined by fold line "$B_2$". The lower portion 233 can be printed with indicia indicating the location of a postage stamp, location of addressee information, and location of return address information. Alternatively, a label providing such indicia may be adhesively secured to the lower portion 233 in lieu of printing such indicia directly on the lower portion 233. Alternatively yet, the lower portion 233 may be provided with an address window (not shown), as described hereinabove.

To expose the flexible sheet of magnetic material 270, such as, for example, when an individual wishes to magnetically secured the pocket frame 200 to a magnetic surface, the individual grasps one edge of the tear-out portion 245 being defined by a respective side edge 246, 248 of the protective flap 240, and pulls upwardly therefrom, thereby tearing the protective flap 240 along the perforation lines 42 and fold line "$A_2$", removing the tear-out portion 45 therefrom.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A magnetic pocket frame, comprising:

a planar blank including first and second planar surfaces, and first and second fold lines, said first and second fold lines dividing said planar blank into a back wall portion, a protective flap being disposed adjacent said back wall portion along said first fold line, and a pocket-forming flap being disposed adjacent said back wall portion along said second fold line;

a flexible magnetic sheet adhesively secured to said second planar surface of said pocket-forming flap, said flexible magnetic sheet being capable of magnetically holding said magnetic pocket frame to a magnetic surface in any angular orientation thereto;

a first opening provided through said back wall portion;

first and second continuous perforation lines extending transversely across said protective flap from a first side edge thereof to a second side edge thereof;

said pocket-forming flap being folded about said second fold line over said back wall portion and being secured thereto at at least one preselected location thereon, thereby forming a pocket between said back wall portion and said pocket-forming flap;

said protective flap being folded about said first fold line over said pocket-forming flap and being secured thereto at at least one preselected location thereon, said at least one preselected location being disposed between said flexible magnetic sheet and said second fold line, said flexible magnetic sheet being disposed completely between said first and second perforation lines.

2. The magnetic pocket frame of claim 1, further comprising:

an insert, said insert being receivable within said pocket.

3. The magnetic pocket frame of claim 1, said back wall portion including:

at least one side flap thereof extending outwardly therefrom, said at least one side flap being foldable thereover about a flap section fold line, said pocket-forming flap being secured to said at least one side flap of said back wall portion.

4. The magnetic pocket frame of claim 1, further comprising:

a first transparent film secured to said first planar surface of said planar blank over said first opening.

5. The magnetic pocket frame of claim 1, further comprising:

a second opening provided through said pocket-forming flap.

6. The magnetic pocket frame of claim 5, further comprising:

a second transparent film secured to said first planar surface of said planar blank over said second opening.

7. The magnetic pocket frame of claim 1, wherein:

said second perforation line is coincident with said first fold line.

8. The magnetic pocket frame of claim 1, wherein:

a portion of said protective flap between an outermost longitudinal edge thereof and said first perforation line defines a tab, said tab being secured to said pocket-forming flap.

9. The magnetic pocket frame of claim 8, wherein:

a first side edge of said tab is disposed between said first side edge of said protective flap and said second side edge of said protective flap.

10. The magnetic pocket frame of claim 9, wherein:

a second side edge of said tab is disposed between said first side edge of said tab and said second side edge of said protective flap.

11. The magnetic pocket frame of claim 1, wherein:

a portion of said protective flap between said first perforation line and said second perforation line defines a removable strip, wherein removing said removable strip exposes said magnetic sheet.

12. The magnetic pocket frame of claim 1, further comprising:

an address label secured to said second planar surface of said pocket-forming flap.

13. The magnetic pocket frame of claim 1, wherein:

said insert is selected from the group consisting of a menu, at least one coupon, a certificate, and a photograph.

* * * * *